US008395460B2

(12) United States Patent
Khan et al.

(10) Patent No.: US 8,395,460 B2
(45) Date of Patent: Mar. 12, 2013

(54) LOW LOSS RF TRANSCEIVER COMBINER

(75) Inventors: Nadeem Khan, Sunrise, FL (US); William Pistole, III, Clearwater, FL (US)

(73) Assignee: xG Technology, Inc., Sarasota, FL (US)

( * ) Notice: Subject to any disclaimer, the term of this patent is extended or adjusted under 35 U.S.C. 154(b) by 331 days.

(21) Appl. No.: 12/930,538

(22) Filed: Jan. 10, 2011

(65) Prior Publication Data

US 2012/0019336 A1 Jan. 26, 2012

Related U.S. Application Data

(60) Provisional application No. 61/335,810, filed on Jan. 12, 2010.

(51) Int. Cl.
*H01P 5/12* (2006.01)

(52) U.S. Cl. ..... 333/128; 333/127

(58) Field of Classification Search ..... 333/125, 333/126, 127, 128, 134, 136
See application file for complete search history.

(56) References Cited

U.S. PATENT DOCUMENTS 4,543,545 A * 9/1985 Craine et al. ..... 333/128
4,667,172 A * 5/1987 Longshore et al. ..... 333/134
5,410,281 A * 4/1995 Blum ..... 333/127
5,563,558 A * 10/1996 Mohwinkel et al. ..... 333/127
5,576,671 A * 11/1996 Agar et al. ..... 333/128
5,872,491 A * 2/1999 Kim et al. ..... 333/101

* cited by examiner

*Primary Examiner* — Dean O Takaoka
(74) *Attorney, Agent, or Firm* — Dennis L. Cook, Esq.

(57) ABSTRACT

A Radio Frequency (RF) splitter/combiner technique for splitting and combining RF signals using a combination of microstrip traces and coaxial cable for an N-port network is disclosed.

2 Claims, 5 Drawing Sheets

LOW LOSS RF TRANSCEIVER COMBINER

CROSS-REFERENCE TO RELATED APPLICATION

The present application claims the benefit of previously filed Provisional Patent Application Ser. No. 61/335,810 filed Jan. 12, 2010.

FIELD OF THE INVENTION

This invention addresses a method to split and combine RF signals. Specifically, this disclosure describes a Radio Frequency (RF) splitter/combiner technique for splitting and combining the signals using a combination of microstrip traces and coaxial cable for an N-port network. The insertion loss experienced by this technique is minimal compared to traditional techniques used for splitting and combining RF signals.

BACKGROUND OF THE INVENTION

Commonly used techniques for splitter/combiner realizations are Wilkinson (resistive, impedance matching transformer section of RF transmission line such as coaxial line, microstrip, stripline etc in various configurations), reactive and hybrid. In applications where high volume, high power, low insertion loss, and low-cost component production is desirable, realizing an N-way power splitter/combiner is difficult and expensive, requiring the use of circuits assembled from multiple substrate layers and/or the use of discrete resistors rather than printed or etched resistors. These costs and difficulties have limited the usefulness of N-way power dividers.

The present invention solves these and other problems by providing a passive power splitter/combiner as a combination of microstrip traces and coaxial cable, resulting in substantially reduced insertion loss, low manufacturing cost, faster assembly time, high reliability, and high repeatability with no power consumption.

BRIEF SUMMARY OF THE INVENTION

This disclosure describes a Radio Frequency (RF) splitter/combiner technique for splitting and combining the signals using a combination of microstrip traces and coaxial cable for an N-port network. The insertion loss experienced by this technique is minimal compared to traditional techniques used for splitting and combining RF signals.

For a fuller understanding of the nature and objects of the invention, reference should be made to the following detailed description taken in connection with the accompanying drawings.

DESCRIPTION OF THE DRAWINGS

For a fuller understanding of the nature and objects of the invention, reference should be made to the accompanying drawings, in which.

DETAILED DESCRIPTION OF THE INVENTION

Figure 1:
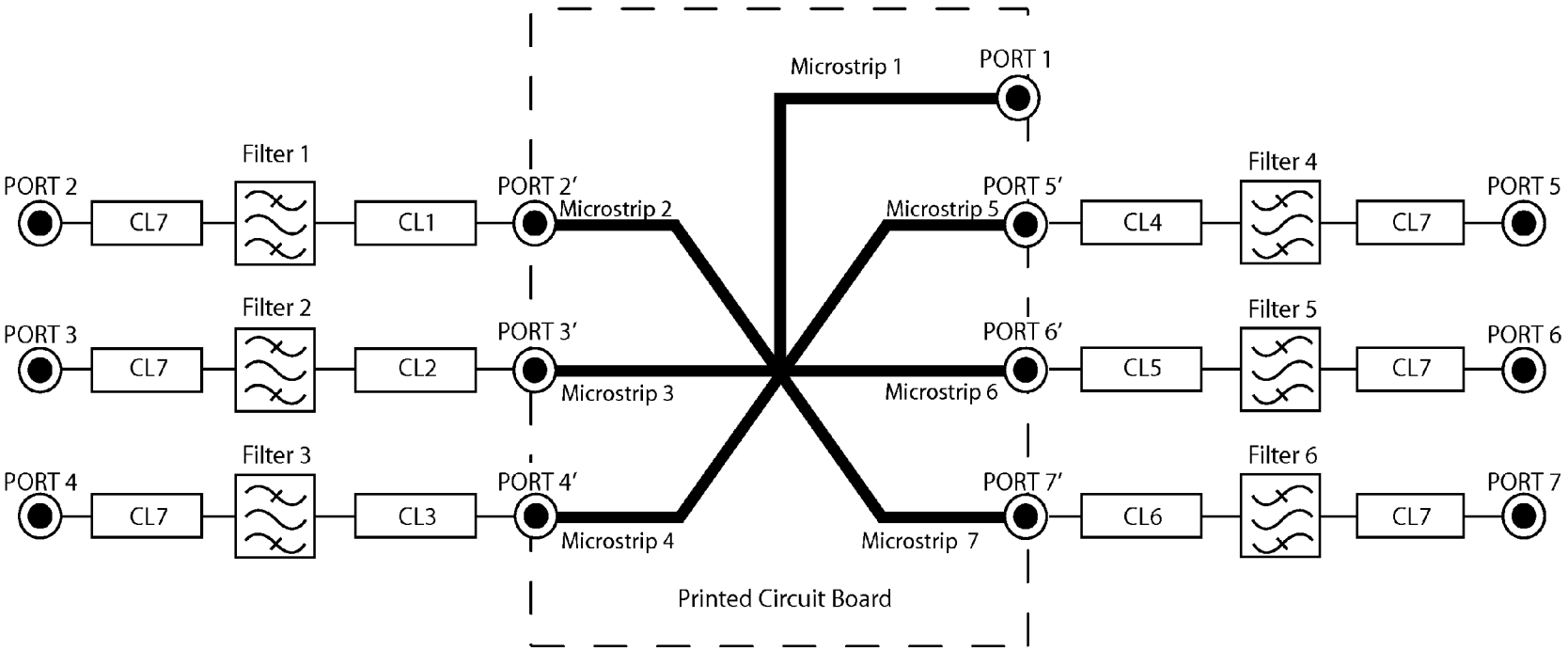
FIG. 1 is a block diagram of a preferred embodiment.

Splitter/combiners are electronic networks that provide one common port and two or more independent ports. When RF power is applied to the common port, and delivered to the independent ports, then the circuit operates as a splitter. When power is applied to the independent ports the combination of individual signals is added linearly at the common port, then the circuit operates as a combiner. The combiner is not a mixer because it is linear, and thus does not produce additional frequency products.

There are three main types of RF splitter/combiners: Zero Degree (0°), Ninety Degree (90°) hybrid and One Hundred Eighty Degree (180°) hybrid. Zero-degree RF dividers split an input signal into two or more output signals that are theoretically equal in both amplitude and phase. Zero-degree RF combiners join multiple input signals to provide one output. Ninety-degree hybrids split an input signal into two equal amplitude output signals, which are 90° out of phase from each other. In addition, 90° hybrids can be used as RF power combiners. One hundred eighty-degree hybrids split an input signal into two signals of equal amplitude and phase when the input signal is applied into one of its two input ports, and two equal amplitude signals that are 180° out of phase with each other when the input signal is applied at its other input port.

Consider a Zero degree phase shift splitter/combiner. When used as a splitter equal amplitude signals are delivered to the respective independent ports. Also, in the splitter mode, except for the purely resistive network, there is a high degree of port-to-port isolation between the independent ports.

The minimum theoretical splitter mode insertion loss occurs because the power is split into N different channels, and is calculated from:

$$\text{Insertion loss(dB)} = 10 \log_{10}(N) \text{ where N is the number of independent ports.}$$

The following table shows the insertion loss for an N port device:

| Ports (N) | Insertion loss (dB) |
|---|---|
| 2 | 3.0 |
| 3 | 4.8 |
| 4 | 6.0 |
| 5 | 7.0 |
| 6 | 7.8 |
| 7 | 8.5 |
| 8 | 9.0 |
| 10 | 10.0 |
| 12 | 10.8 |
| 15 | 11.8 |
| 20 | 13.0 |
| 30 | 14.8 |

The splitter mode is used for a number of different purposes in RF circuits or test setups. It can be used to provide a number of identical output signals from one input signal applied to the common port. In the combiner mode it can be used for vector addition or subtraction of signals. The power combiner will exhibit an insertion loss that varies depending upon the phase and amplitude relationship of the signals being combined. For example, in a 2 way 0° power splitter/combiner, if the two input signals are equal in amplitude and are in-phase then the insertion loss is zero. However, if the signals are 180° out-of-phase the insertion loss is infinite. And, if the two signals are at different frequencies, the insertion loss will equal the theoretical insertion loss shown in the table above.

The power combiner will also exhibit isolation between the input ports. The amount of isolation will depend upon the impedance termination at the common port. For example, in the 2 way 0° power splitter/combiner, if the common port is open then the isolation between input ports would be 6 dB. And, if the common port is terminated by matched impedance (for maximum power transfer), then the isolation between input ports would be infinite.

The following signal processing functions can be accomplished by power splitter/combiners:

- Add or subtract signals vectorially.
- Obtain multi in-phase output signals proportional to the level of a common input signal.
- Split an input signal into multi-outputs.
- Combine signals from different sources to obtain a single port output.
- Provide a capability to obtain RF logic arrangements.

While the present invention can be scaled to any frequency band, one example of the present invention specifically tuned for ISM 900 MHz band is described below as the preferred embodiment. The ISM 900 MHz band (in USA) spans from 902 MHz to 928 MHz. Products offered in this band by numerous manufacturers range from a simple application like a baby monitor or a garage door opener to more sophisticated products like a nationwide mobile VoIP solution.

The present invention targets a 6-way reactive star combiner. That is it has six input ports and one output port. Each port has an impedance of 50 ohms. The six input ports or channels are spaced 5 MHz apart. Each channel has a 3 dB bandwidth of 2 MHz. The effective bandwidth of this combiner is 26 MHz making it a low loss wideband reactive combiner. A block diagram of the preferred embodiment is shown in FIG. 1.

The invention consists of microstrip transmission lines etched on a printed circuit board and a combination of various length coaxial cables attached to the six ports of the circuit board.

The printed circuit board (marked with a dotted line in FIG. 1) is constructed with stepped microstrip transmission lines that act as transformers, the steps are chamfered to minimize reflections, transforming 50 ohms to 200 ohms. 300 ohms could not be realized with the size constraints and power handling requirements. The properties of the dielectric substrate are listed below:

- Material used is Rogers RT5880.
- Dielectric constant is 2.2.
- Tan D=0.0002.
- Properties of the printed circuit board are:
- Thickness of the printed circuit board is 62 mils.
- Two sided board.
- Microstrip transmission line on one side and a solid ground plane on the other side.
- Cladding is 1 oz Copper on both sides.

Coaxial cables of specific lengths are used on all the six ports. The length of the coaxial cable is selected so that the phases of all the signals are in sync. In the block diagram CL1, CL2, CL3, CL4, CL5 and CL6 represent coaxial cables of specific lengths.

CL7 shown in FIG. 1 is also coaxial cable. The length of this cable is not significant. It may or may not be the same length on all the ports.

Filter 1, Filter 2, Filter 3, Filter 4, Filter 5 and Filter 6 are band pass filters that are tuned at specific frequencies. They are not only used for selectivity but are also used for improving the isolation between the six ports.

Figure 2:
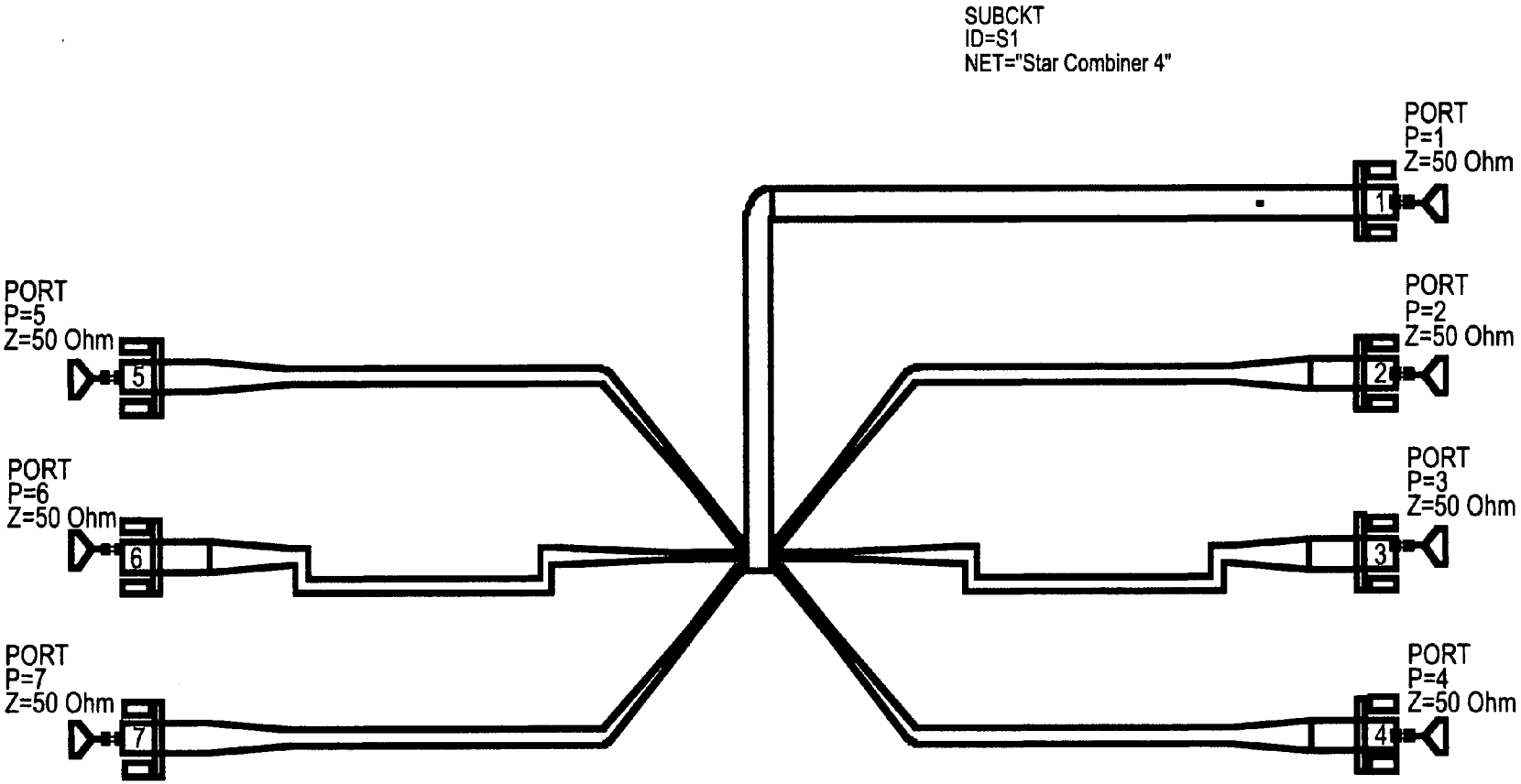
FIG. 2 is a schematic of a preferred embodiment.

A signal at specific frequencies is applied at Port 2, Port 3, Port 4, Port 5, Port 6 and Port 7. The combined signal appears on Port 1. In this case the preferred embodiment acts as a signal combiner. When a signal is applied at Port 1, it is split into six paths. The split signal appears on Port 2', Port 3', Port 4', Port 5', Port 6' and Port 7'. Since a band pass filter is connected to each port through a specific length of coaxial cable (CL's), only a signal specific to a frequency reaches the output port. Band pass filters reject any signal outside their bandwidth. A schematic of a printed circuit board of the preferred embodiment is shown in FIG. 2.

By changing the length of the coaxial cable, the present invention can be used for different sets of frequencies. Three such frequency sets named sector 1, sector 2 and sector 3 are realized using the same combiner board.

Figure 3:
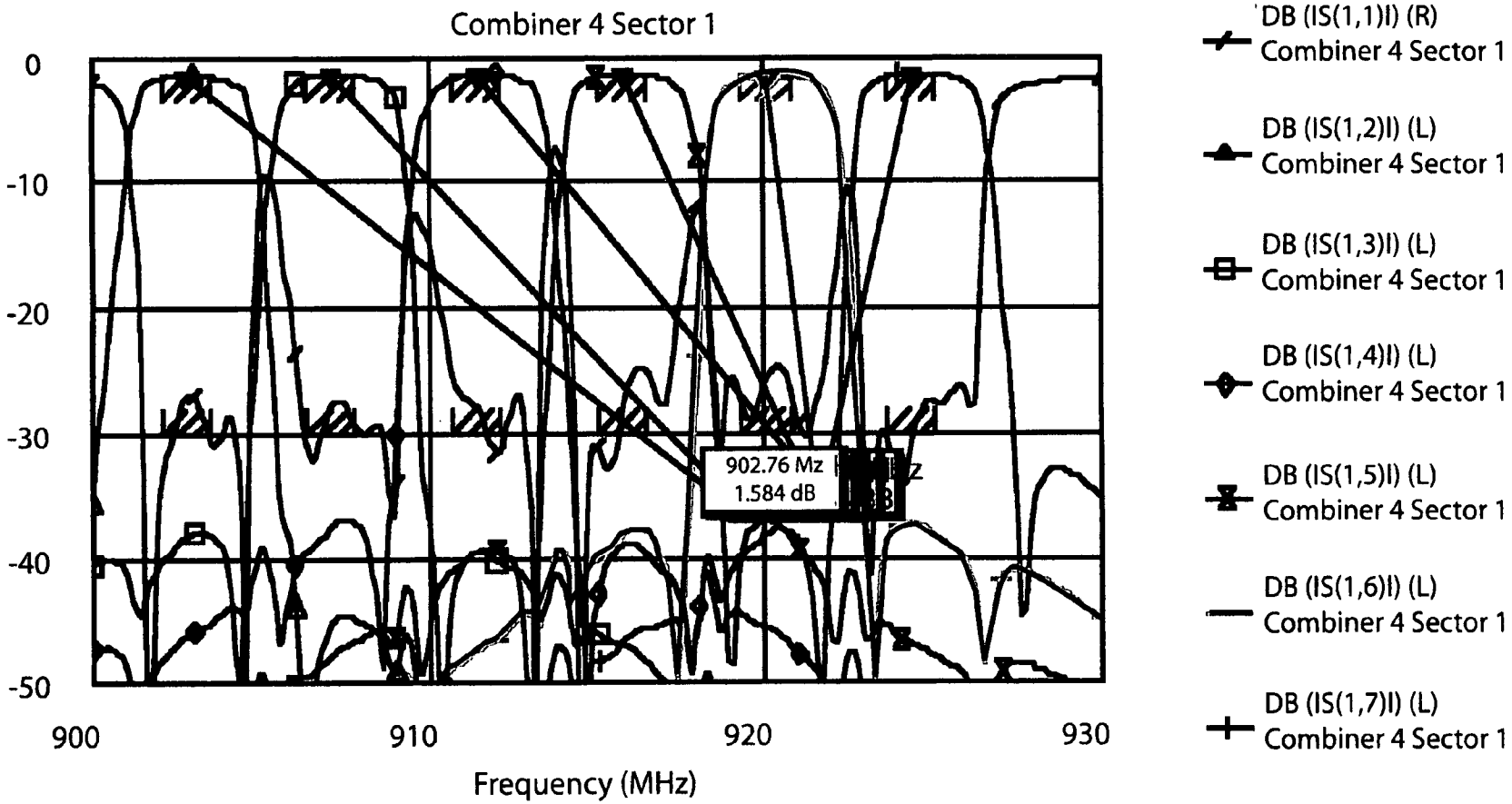
FIG. 3 is a graph showing insertion loss and input impedance.
Figure 4:
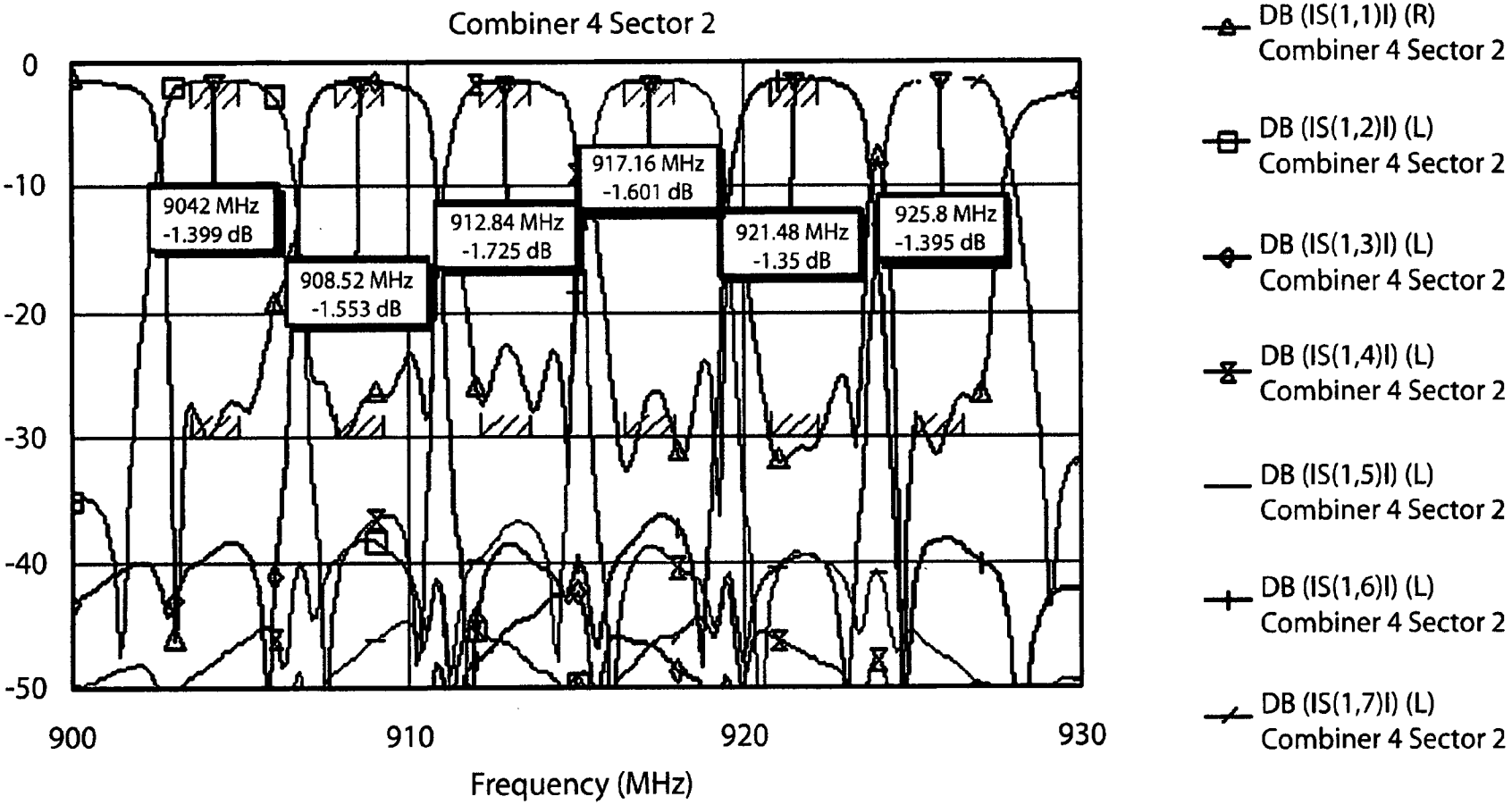
FIG. 4 is a graph showing insertion loss and input impedance.
Figure 5:
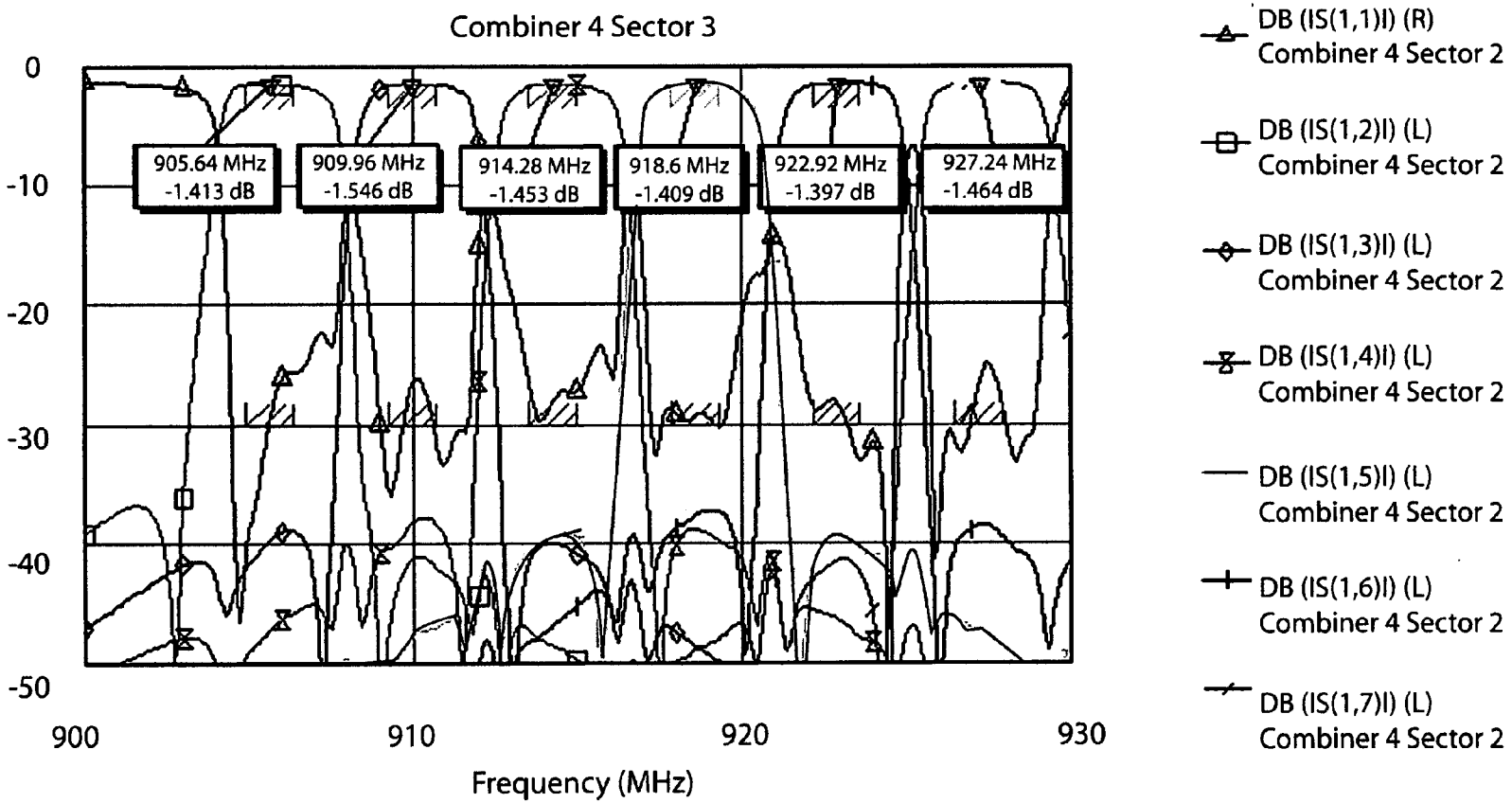
FIG. 5 is a graph showing insertion loss and input impedance.

The three graphs shown in FIGS. 3, 4, and 5 portray the insertion loss and input impedance of the system using the preferred embodiment. From FIG. 3 the reader can see that the insertion loss for all the six frequencies is same and is −1.584 dB. From FIG. 4 the reader can see that the insertion loss for all the six frequencies is different and it varies between −1.396 dB to −1.725 dB. From FIG. 5 the reader can see that the insertion loss for all the six frequencies is different and it varies between −1.397 dB to −1.546 dB In summary the present invention has the following advantages:

- Very low insertion loss.
- Printed circuit board does not require any electronic parts and requires only 7 connectors.
- Capable of handling high output power.
- Low cost of manufacturing.
- Easy to assemble which reduces assembly time.
- No active components are used in the present invention, therefore, it has zero power consumption.
- Easily scaled to any set of frequencies by changing the length of coaxial lines.
- Since no components are used, there are no component tolerances on the printed circuit boards. This results in high repeatability.

Since certain changes may be made in the above described Radio Frequency (RF) splitter/combiner technique for splitting and combining the signals using a combination of microstrip traces and coaxial cable for an N-port network without departing from the scope of the invention herein involved it is intended that all matter contained in the description thereof, or shown in the accompanying figures, shall be interpreted as illustrative and not in a limiting sense.

What is claimed is:

1. A low loss combiner/divider for combining or dividing multiple differing frequency signals from one common input/output port to numerous independent input/output ports comprising: a printed circuit board having a first side and a second side and having a solid ground plane on the first side; said printed circuit board having etched on the second side a common port microstrip transmission line that is electrically connected at one end to a common input/output port; said printed circuit board having two or more stepped microstrip transmission lines etched on the second side such that said stepped microstrip transmission lines act as connectors and transformers and each of said two or more stepped microstrip transmission lines electrically connected at one end to said common port microstrip transmission line at the other end of said common port microstrip transmission line from the connection to said common input/output port; two or more coaxial cables of varying lengths with such lengths selected such that the phases of the differing frequency signals are phase synchronized wherein said two or more coaxial cables are electrically connected to each of said two or more stepped microstrip transmission lines at the end opposite the connection to said common port microstrip transmission line; two or more band pass filters electrically connected to each of said two or more coaxial cables at the opposite end from the connection of said two or more stepped microstrip transmission lines wherein the center frequency of each of said two or more band pass filters is the same as the each of said multiple differing frequency signals; and, two or more additional coaxial cables electrically connected to said two or more band pass filters and connected at the opposite end to said two or more independent input/output ports.

2. The low loss combiner/divider of claim 1 wherein two or more alternative independent input/output ports are located at the connection between said two or more stepped microstrip transmission lines and said two or more coaxial cables of varying lengths.

* * * * *